United States Patent [19]

Vanderslice

[11] Patent Number: 4,816,167

[45] Date of Patent: Mar. 28, 1989

[54] PORTABLE SYSTEM FOR DEWATERING CONTENTS OF SANITARY SEWER TRAPS

[75] Inventor: Daniel V. Vanderslice, Denham Springs, La.

[73] Assignee: Waste Management, Inc., Oak Brook, Ill.

[21] Appl. No.: 151,029

[22] Filed: Feb. 1, 1988

[51] Int. Cl.[4] ..... C02F 1/40

[52] U.S. Cl. ..... 210/776; 210/801; 210/241; 210/244; 210/520; 210/96.1; 210/188

[58] Field of Search ..... 210/776, 801, 803, 96.1, 210/188, 241, 244, 320, 406, 436, 521, 522

[56] References Cited

U.S. PATENT DOCUMENTS

| | | | |
|---|---|---|---|
| Re. 27,346 | 4/1972 | Naylor | 134/169 R |
| 31,891 | 4/1861 | Wilkinson . | |
| 48,559 | 7/1865 | Kaufman . | |
| 1,295,056 | 2/1919 | Otterson . | |
| 1,437,007 | 11/1922 | Otterson . | |
| 3,483,981 | 12/1969 | Gordon | 210/167 |
| 3,893,656 | 7/1975 | Opacic et al. | 259/7 |
| 4,040,960 | 8/1977 | Taylor et al. | 210/96 R |
| 4,113,617 | 9/1978 | Bereskin et al. | 210/72 |
| 4,159,248 | 6/1979 | Taylor et al. | 210/96.1 |
| 4,160,734 | 7/1979 | Taylor et al. | 210/96.1 |
| 4,200,535 | 4/1980 | Kennedy, Jr. | 210/241 |
| 4,208,291 | 6/1980 | Ochoa | 210/522 |
| 4,213,479 | 7/1980 | Pearson | 137/493 |
| 4,367,145 | 1/1983 | Simpson et al. | 210/241 |
| 4,378,290 | 3/1983 | Kennedy, Jr. | 210/103 |
| 4,389,314 | 6/1983 | Petretti | 210/241 |
| 4,436,622 | 3/1984 | Petretti | 210/232 |
| 4,525,277 | 6/1985 | Poulin | 210/241 X |
| 4,543,183 | 9/1985 | Petretti | 210/187 |

FOREIGN PATENT DOCUMENTS 2004859A 4/1979 United Kingdom .

OTHER PUBLICATIONS

EPA Handbook, "Septage Treatment and Disposal", pp. 247-252, Oct. 1984, EPA-625/6-84-009.

*Primary Examiner*—Charles Hart

*Attorney, Agent, or Firm*—Fitch, Even, Tabin & Flannery

[57] ABSTRACT

A vehicle for collecting and dewatering the contents of sanitary sewer traps. The vehicle includes a frame and an elongated tank mounted on the frame with the tank having a rearward end and a forward end. The frame includes a mechanism for elevating the forward end and the tank is pivotally connected to the frame adjacent the rearward end of the tank. A divider separates the tank into a rearward compartment for receiving the contents of the traps and a forward compartment, while a cross-over pipe for conveying supernatant liquid from the rearward compartment to the forward compartment has a first leg extending generally parallel to the divider wall from a location adjacent the floor of the rearward compartment. An inlet conduit extends into the rearward compartment for conveying the contents of the traps into the rearward compartment. The vehicle also includes a pump for selectively establishing a subatmospheric pressure in either the rearward compartment or in the forward compartment. The vehicle also includes a vent for the rearward compartment for placing it at atmopsheric pressure so that upon elevating the tank, venting the rearward compartment, establishing a subatmospheric pressure in the forward compartment and controllably lowering the tank, supernatant liquid is drawn into the forward compartment. A method of using the vehicle is also disclosed.

12 Claims, 6 Drawing Sheets

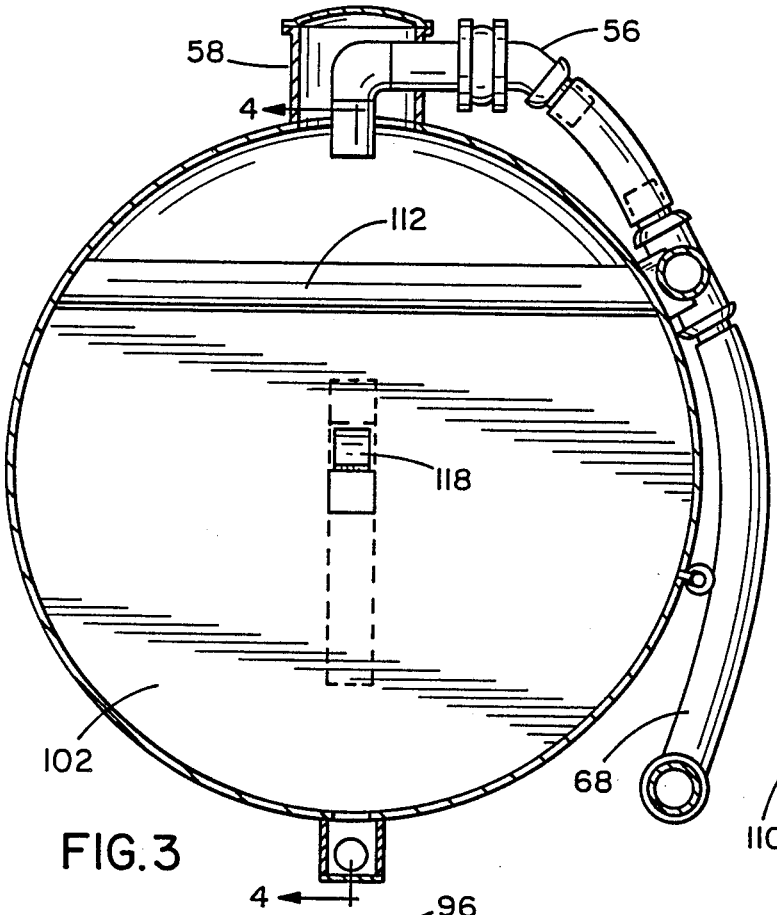
FIG.3
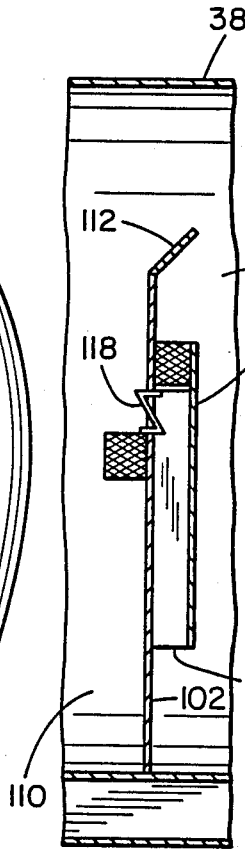
FIG.4
FIG.5
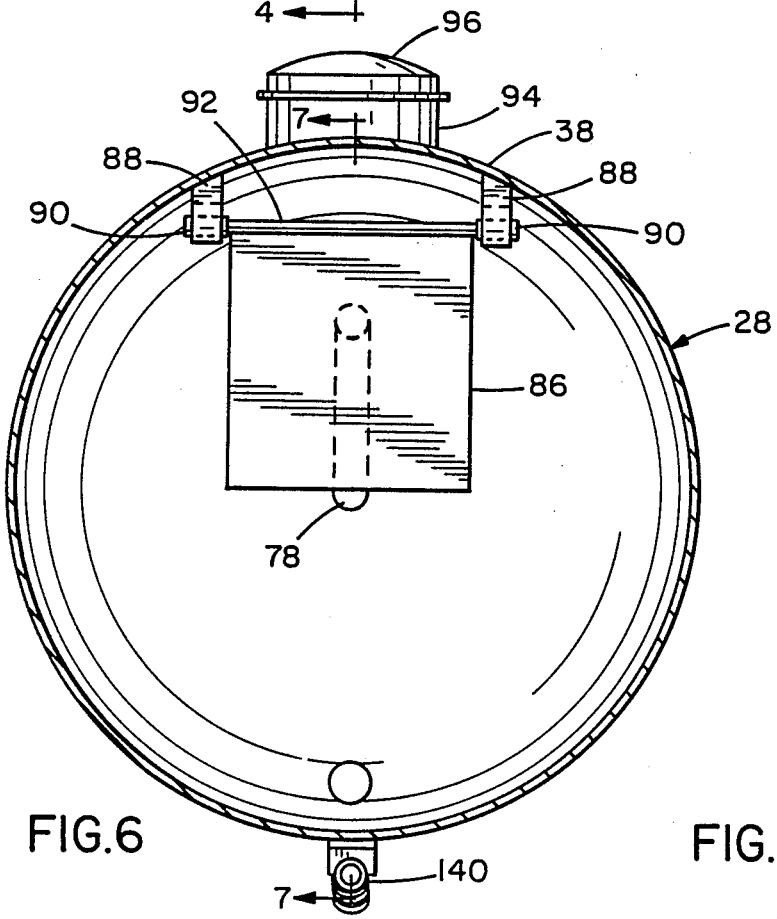
FIG.6
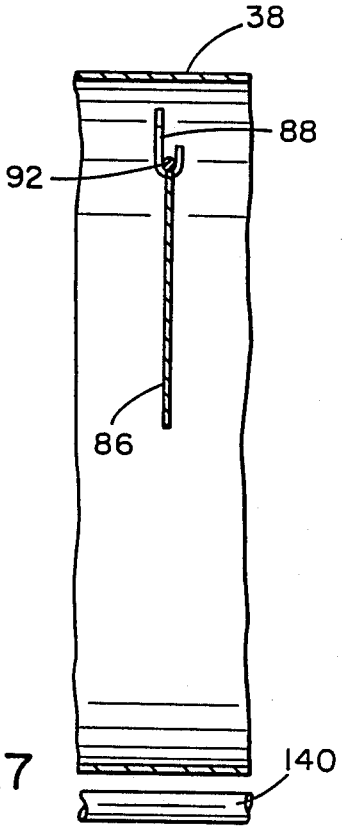
FIG.7

PORTABLE SYSTEM FOR DEWATERING CONTENTS OF SANITARY SEWER TRAPS

This invention relates to waste disposal systems and, more specifically, to a vehicle-mounted system for dewatering the contents of a sanitary sewer trap sufficiently that the remaining sludge is without substantial free liquids.

BACKGROUND OF THE INVENTION

Grease traps at commercial establishments, such as fast food restaurants, contain not only grease but also a great deal of water and sediment including sand and dirt. It is common practice to clean out a grease trap using a "vacuum" truck having a tank in which is established a subatmospheric pressure to draw the contents of the trap into the tank through a suction hose. The turbulence caused by the suction mixes the contents of the trap and much sand and dirt is drawn into the tank with the water and grease.

Under certain state solid waste regulations, these contents cannot be taken to a sanitary landfill and dumped because the contents include "free liquids". These are defined as liquids which readily separate from the solid portion of a waste under ambient temperature and pressure. Additionally the contents cannot be readily processed at a typical waste treatment plant because of the grease, which tends to clog various processing equipment thereby increasing maintenance and downtime.

If the grease trap contents can be sufficiently dewatered that the remainder, which is termed "sludge", has at least 15% solids, the solids will hold the liquids so that there are no free liquids. This sludge, with at least 15% solids, is "bladeable", meaning that it can be taken to a sanitary landfill, dumped and spread to dry by means of, for example, a bulldozer.

SUMMARY OF THE INVENTION

Among the several aspects of the present invention may be noted the provision of an improved vacuum truck which dewaters the contents of sanitary sewer traps sufficiently that the remaining sludge is without free liquids so that it may be dumped at a sanitary landfill. The truck also provides sufficiently clear liquids that can be drained into a sanitary sewer system. Furthermore the truck is, in essence, self-cleaning in that it is generally only necessary to dump bladeable sludge and to drain relatively clear liquid to dispose of the contents received by the truck. Additionally, the truck has long service life, is reliable in use and is relatively easy and economical to manufacture. Other aspects and features of the present invention will be, in part, apparent and, in part, pointed out hereinafter in the following specification and in the accompanying drawings.

Briefly, the vehicle includes a frame with an elongated tank mounted on the frame with the tank having a rearward end and a forward end. The vehicle has means for elevating the forward end and the tank is pivotally connected to the frame adjacent the rearward end. Positioned inside the tank is a vertical divider wall separating the tank into a rearward compartment and a forward compartment and a crossover pipe, for conveying supernatant liquid from the rearward compartment to the forward compartment, has a first leg extending generally parallel to the divider wall from a location adjacent the floor of the rearward compartment. The vehicle further includes pump means for selectively establishing a subatmospheric pressure in the rearward compartment or the forward compartment and further has means for venting the rearward compartment to atmosphere.

As a method, the present invention includes several steps:

(a) a subatmospheric pressure is established in the rearward compartment to draw the contents of a trap into the rearward compartment through an inlet conduit;

(b) after the contents of a number traps are received, the tank is elevated;

(c) a subatmospheric pressure is established in the forward compartment and the rearward compartment is vented to atmosphere to draw the supernatant liquid into the forward compartment through the crossover pipe; and (d) the subatmospheric pressure is maintained in the forward compartment while the tank is lowered in a controlled manner until the contents of the rearward compartment are dewatered.

BRIEF DESCRIPTION OF THE DRAWINGS

FIG. 3 is a sectional view taken generally along line 3—3 of FIG. 2 illustrating a barrier wall in the forward compartment further dividing the tank into subcompartments;

FIG. 4 is a sectional view taken generally along line 4—4 of FIG. 3 depicting the barrier wall with a baffle having an inlet in a rear subcompartment and an outlet in an intermediate subcompartment;

FIG. 5 is a front elevational view of the baffle;

FIG. 6 is a sectional view taken generally along line 6—6 of FIG. 2 showing a striker plate pivotally carried by the tank ceiling in the rear compartment;

FIG. 7 is a sectional view taken generally along line 7—7 of FIG. 6 illustrating the swingable striker plate;

Corresponding reference numerals indicate corresponding components throughout the several views of the drawings.

DESCRIPTION OF THE PREFERRED EMBODIMENT

Figure 1:
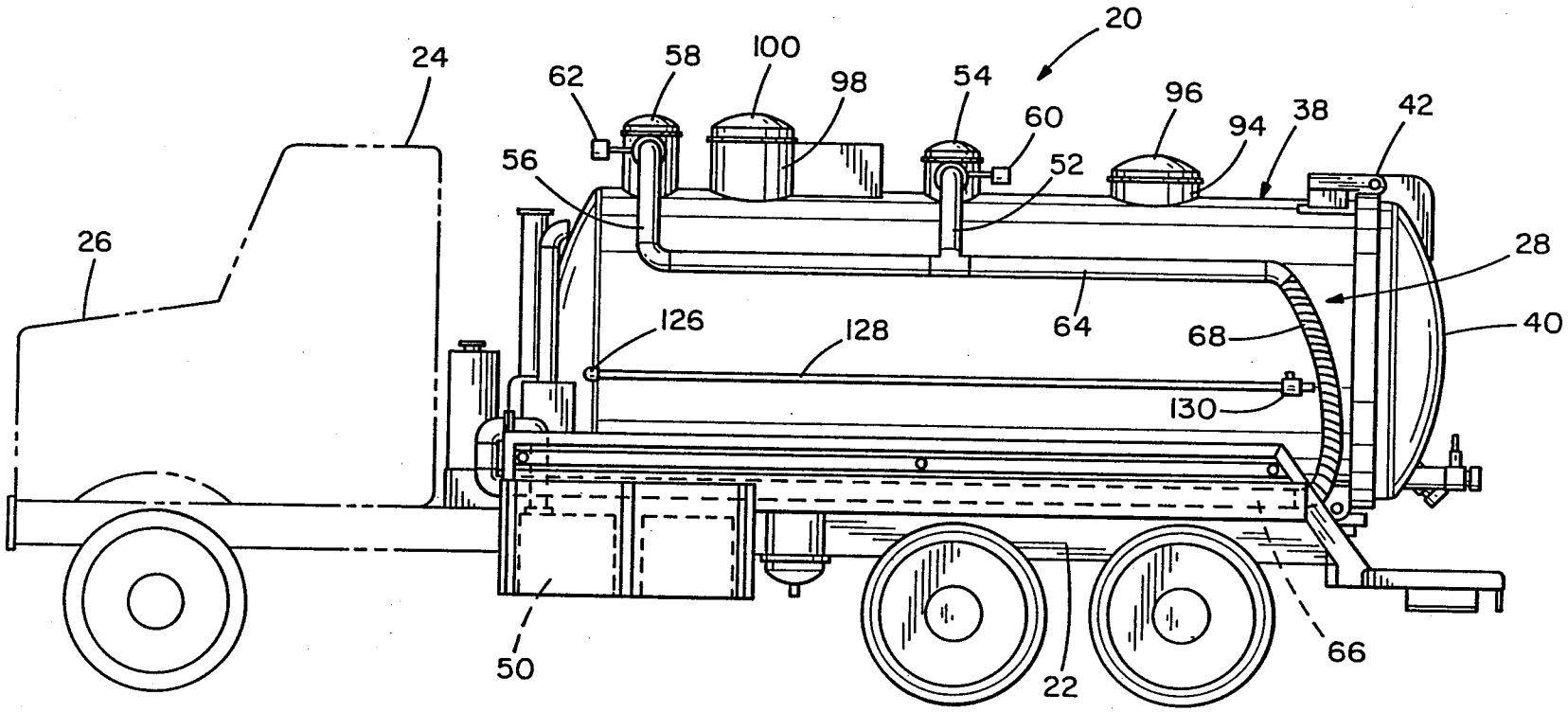
FIG. 1 is a side elevational view of a vacuum truck embodying various aspects of the present invention.

Referring now to the drawings, a vacuum truck embodying various aspects of the present invention is generally indicated in FIG. 1 by reference numeral 20. The truck 20 includes a frame 22, a cab 24 with an engine compartment 26 (both shown in phantom) and an elongated tank 28 mounted behind the cab on the frame. As shown in FIGS. 2 and 8–10, the tank is connected to the frame at the rear by a pivot assembly 30, and the the frame carries means in the form of an extensible cylinder 32 pivotally joined to the floor 34 of the tank 22 for elevating the tank. Such mechanisms are well known to those of skill in the art and need not further be discussed here.

Figure 2:
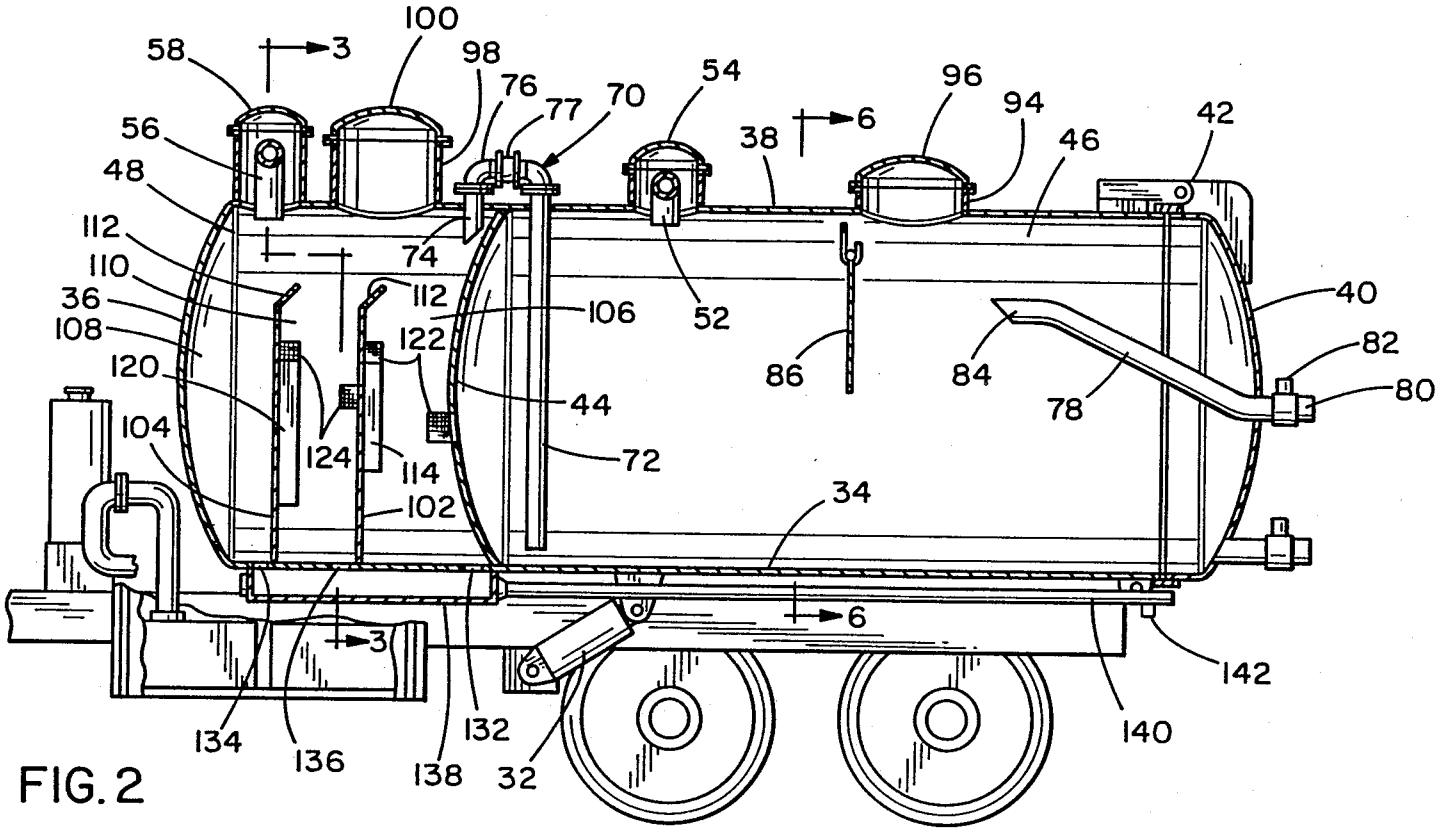
FIG. 2 is a longitudinal cross-sectional view of a tank carried by the truck divided into a rear compartment and a forward compartment by a divider wall.

As shown in FIG. 2, the tank 22 has a forward head 36, a ceiling 38, and a rear door 40 pivotally connected to the ceiling by a pivot assembly 42. As will be understood by those of skill in the art, a suitable holding mechanism (not shown) is provided for holding the door closed and a suitable sealing arrangement is provided about the door to permit pressurization or the establishment of a subatmospheric pressure in the tank without substantial leakage about the door. A generally vertically positioned divider wall 44, similar to forward head 36, divides the tank into rearward compartment 46 and a forward compartment 48.

Referring to FIG. 1, the truck 20 carries a pump 50 operated by means of a power takeoff from the truck engine. Depending on how the pump is connected, it functions to either estabish a superatmospheric pressure or to establish a subatmospheric pressure in one of the compartments. The tank 28 carries a pipe system including a first branch 52 extending into the rear compartment 46 through a turret 54, a second branch 56 extending into the forward compartment 48 through a turret 58. The branches 52 and 56 have remotely controlled valves 60 and 62, respectively, for selectively opening or closing the branches. The branches join a trunk line 64 which is connected to a pipe 66 joined to the pump and carried by the frame 22, by means of a flexible conduit 68. The valves 60 and 62 have associated means which vents the corresponding compartments 46 and 48 to atmosphere when the respective valves are closed to operation of the pump 50.

Referring again to FIG. 2, a crossover pipe 70 for conveying supernatant liquid from the rear compartment 46 to the forward compartment 48 includes a first leg 72 extending generally parallel to the divider wall 44 from a location adjacent the tank floor 34 in the rear compartment, a second leg 74 extending into the forward compartment adjacent the wall 44, and an intermediate portion 76 joining the legs. The front leg 72 preferably extends 1 to 3 inches from the tank floor and most preferably extends from about 1 inch, while the pipe preferably has a 3 inch I.D. The intermediate portion includes a shutoff valve 77. The rear door 40 is pierced by and supports an inlet conduit 78 having an inlet end 80 outside the tank 28 and provided with a valve 82 for selectively opening and closing the conduit. The conduit has an outlet end 84 positioned to direct the flow from the trap being emptied against a striker plate 86.

The striker plate 86, best shown in FIGS. 6 and 7, is swingably held dependent from the ceiling 38 substantially midway between the ends of the rear compartment 46. A pair of spaced J-shaped hooks 88 dependent from the ceiling 38 receive the extending ends 90 of a horizontal rod 92 affixed to the top of the plate 86. The flow from the conduit 78 impinges upon the striker plate so that the solids in the flow generally fall spaced from the first leg 72. The rear compartment 46 has a roof hatch 94 with a sealing cover 96 to permit visual inspection. Similarly the forward compartment 48 has a roof hatch 98 with a sealing cover 100.

Referring again to FIG. 2, a pair of spaced barrier walls 102, 104 extending from the tank floor 34 in the forward compartment 48 but terminating short of the ceiling 38, operate to subdivide that compartment into a rear subcompartment 106, a forward subcompartment 108 and an intermediate subcompartment 110. Each barrier is provided with a splash plate 112 extending upwardly and rearwardly from its top to protect against grease moving forwardly over the barrier walls due to splashing of the supernatant liquids exiting the second leg 74 of the crossover pipe 70.

The barrier wall 102 has a baffle 114, best shown in FIGS. 3–5. The baffle 114, in the general form of a weir tube, has an inlet end 116 for receiving the supernatant liquid from the rear subcompartment 106 and an outlet end 118 opening into the intermediate subcompartment 110 at a level above the level of the inlet end 116. The baffle functions to permit water to advance to the subcompartment 110 while maintaining grease, which floats on the water, in the rear subcompartment 106. The barrier wall 104 is provided with a similar baffle 120 for permitting water to flow from the intermediate subcompartment 110 to the forward subcompartment 108 without permitting floating grease free access to the forward subcompartment 108.

Tablet containers 122 having mesh walls to permit the flow of liquid therethrough are mounted in the rear subcompartment 106. Tablets of a flocculant (such as alum), to promote precipitation of particles of solid matter coming over with the supernatant liquid, are held in each of the containers 122. Mounted in the intermediate subcompartment 110 are similar tablet containers 124 which hold tablets of a chlorinating agent which functions to destroy bacteria in the liquid. The chemicals are easily loaded into the various containers because the operator has access to the forward compartment 48 through the forward hatch 98.

As best shown in FIG. 1, an outlet pipe 126, extends into the forward subcompartment 108 somewhat above the level of the tank floor 34. The pipe 126 is connected to a drain line 128, preferably having a 1 inch I.D., running along the side of the tank 28. By operation of a valve 130 near the rear of the tank to open the drain line 128, the relatively clear liquid from the forward subcompartment can be drained into, for example, a sanitary sewer system.

Referring again to FIG. 2, the tank floor 34 in the forward compartment 48 has drain holes 132, 134 and 136 for draining sediment accumulating in the rear, forward and intermediate subcompartments 106, 108 and 110, respectively, into an underlying pan 138. A drain pipe 140 is connected to the pan 138 and extends to the rear of the tank 28. A valve 142 is connected to selectively open or close the pipe 140. The pipe 140 permits the sediment in the subcompartments to be drawn into the rear compartment 46, as will be discussed more fully hereinafter. Indicators are provided to inform the operator when the rearward compartment 46 is full and when the forward compartment 48 is full. Additionally gauges and associated sensors are provided to indicate the pressure in the compartments.

Operation of the vacuum truck 20 of the present invention is as follows: Assume that the truck 20 is assigned a route to clean, for example, the grease traps at ten establshments. At the first location, after a standard suction hose is connected to the inlet end 80 of the conduit 78 with the other end of the hose positioned in the first grease trap to be cleaned, the pump 50 can be operated to establish a subatmospheric pressure in the rear compartment 46 by opening valve 60. With the valve 77 of the crossover pipe 70 closed and valve 82 opened, the contents of the grease trap are drawn in the rear compartment 46 with the outlet end 84 of the conduit 78 directing the flow against the swingable striker plate 86. This results in the various solids 144 carried in with the water falling to the tank floor 34 in the rear compartment spaced from the first leg 72 of the crossover pipe 70.

Figure 8:
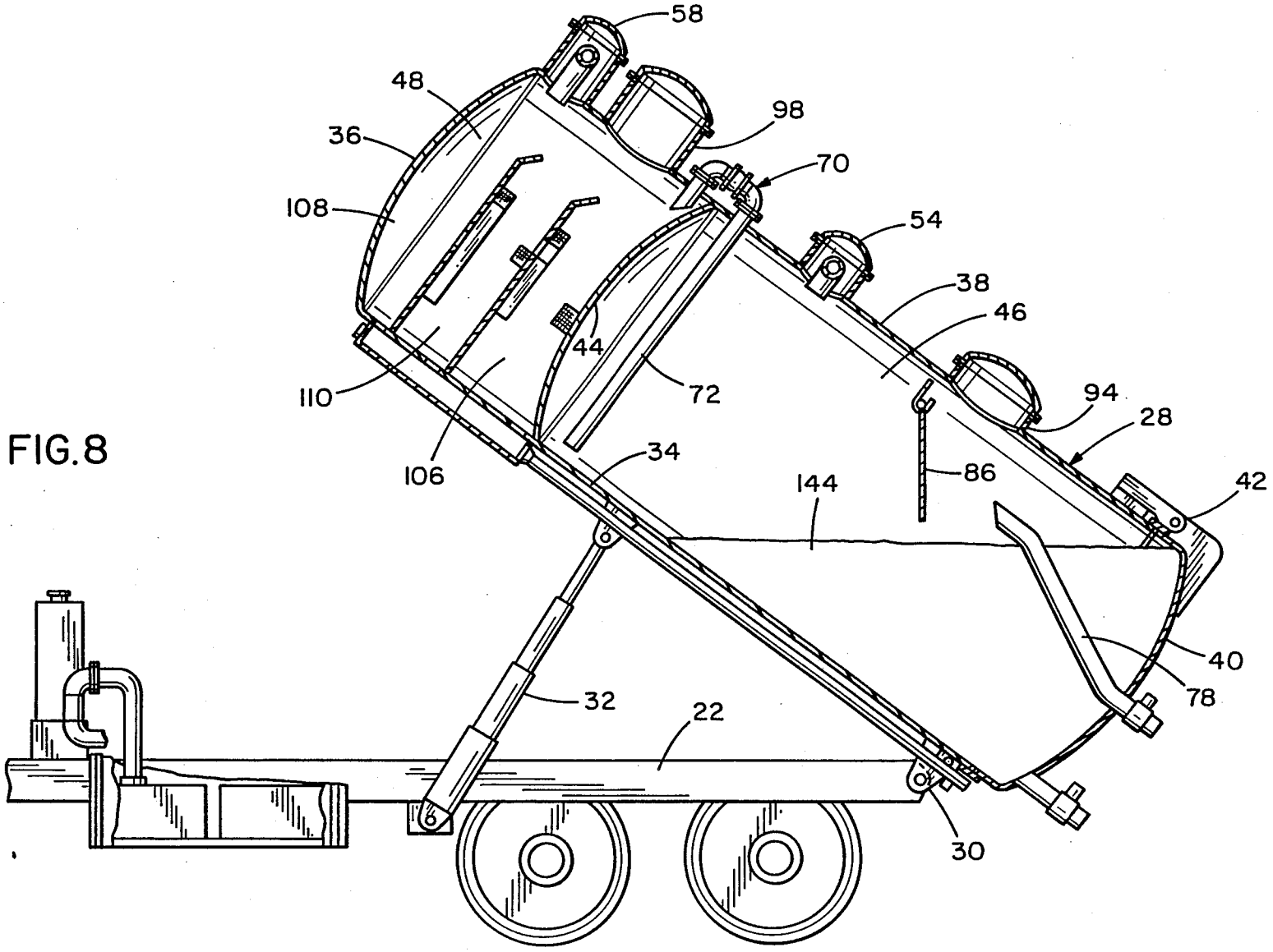
FIG. 8, similar to FIG. 2, shows the tank elevated to a fully operational extent.
Figure 9:
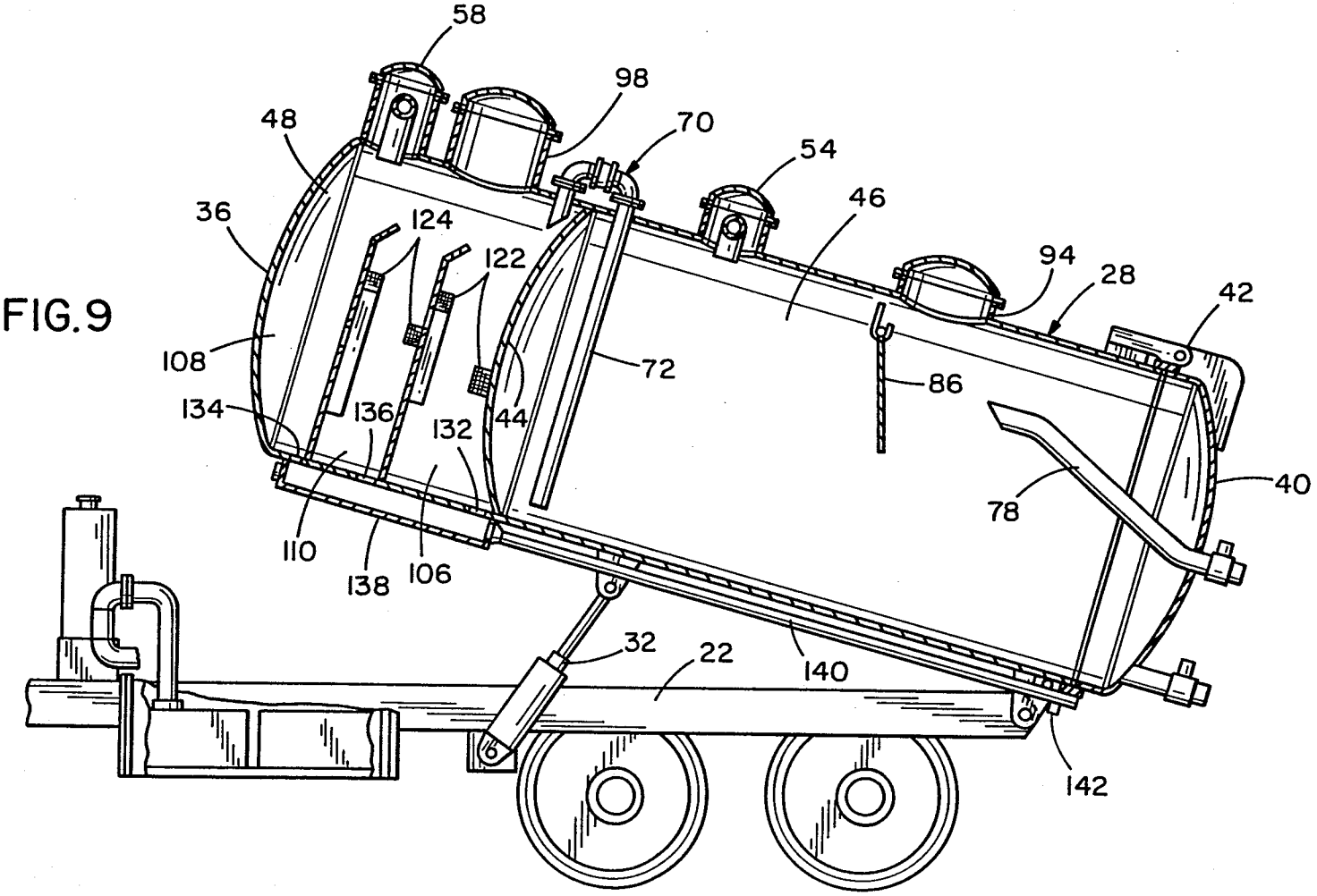
FIG. 9, also similar to FIG. 2, illustrates the tank elevated to a lesser extent.

After a number of traps are cleaned, the tank level mechanism in the rear compartment 46 may indicate that it is full. The operator can then use the extensible cylinder 32 to elevate the tank as shown in FIG. 8. The solids 144 tend to accumulate at the back of the rearward compartment 46 while the supernatant liquid covers the inlet of the first leg 72 of the crossover pipe 70. The operator can switch the pump 50 to establish a superatmospheric pressure in the rear compartment 46, close valve 62 to vent the forward compartment 48 to atmosphere and open the valve 77 of the crossover pipe. This results in the supernatant liquid flowing into the rear subcompartment 106. By controllably lowering the tank, as shown in FIG. 9, a large portion of the supernatant liquid can be brought over into the forward compartment 48, thereby making room in the rear compartment 46 for receiving the contents of additional grease traps to be cleaned on the route.

When the supernatant liquid enters the rear subcompartment 106, it is treated by means of the alum tablets to cause the solid particles to participate. These particles may have adhered to them some of the grease. Remaining grease tends to float on the top of the liquid so that the liquid going through the baffle 114 into the intermediate subcompartment 110 for treatment by the chlorinating agent in the tablets in the containers 124, is relatively free of the grease. The baffle 120 serves to maintain most of any grease coming over into the intermediate subcompartment 110 therein so that the liquid going through the baffle 120 into the forward subcompartment 108 is relatively clear. A hose can be attached to the end of the drain line 128 and the valve 130 opened to drain the clear liquid into a sanitary sewer system.

After completion of the entire route, the tank is again elevated by means of the cylinder 32. This time, however, the rear compartment 46 is vented to atmosphere and the lid 96 of hatch 94 removed. By closing the valve 60 and opening the valve 62 with the pump configured to establish a subatmospheric pressure in the forward compartment 48, the supernatant liquid in the rearward compartment 46 commences to flow through the crossover pipe 70. Because the operator can observe the end of the first leg 72, he can control the elevation of the tank so that the supernatant liquid is continually drawn into the forward compartment 48. Due to the coarse appearance of the solid material in rearward compartment 46, the operator can tell when substantially all of the covering liquid has been drawn off and all that remains in the rear tank is the bladeable material, having at least 15% solids.

Figure 10:
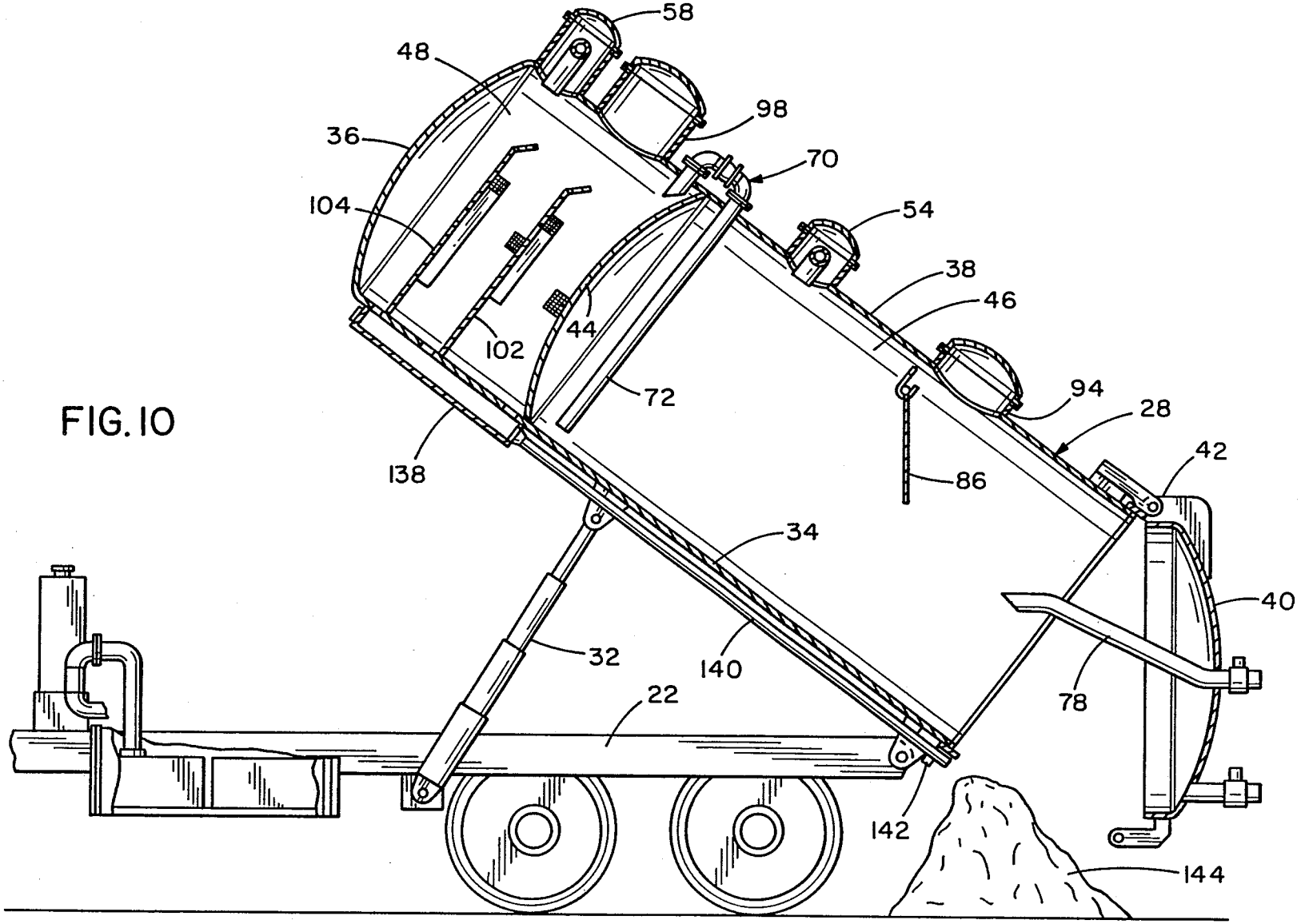
FIG. 10 shows the tank rear hatch open with the dewatered sludge being emptied at a sanitary landfill.

Referring to FIG. 10, the rear door 40 can be opened and the material in the rear compartment dumped at a sanitary landfill. After closing the rear door 40 and lowering the tank, the truck can be driven to a location where again the free liquid can be drained from the forward subcompartment 108 using the drain line 128. After draining the clear liquid from the subcompartment 108, the forward valve 62 can be closed to vent the forward compartment 48, and the rear valve 60 can be opened to open the rearward compartment 46 to the action of the pump 50. By connecting the drain pipe 140 to the inlet conduit 78, opening the valves 82 and 142 and establishing the subatmospheric pressure in the rear compartment, the sediment and any remaining liquids in the subcompartments 106, 108 and 110 are drawn into the rear compartment thereby cleaning the forward compartment 48. While the truck 20 has been described in the context of cleaning grease traps, it will be apparent that it has utility for cleaning sanitary sewer traps generally.

As a method of dewatering the contents of a number of sewer traps so that the sludge remaining after dewatering is bladeable, the present invention includes several steps:

(a) a subatmospheric pressure is established in the rearward compartment 46 to draw the contents of a trap into the rearward compartment through an inlet conduit 78;

(b) after the contents of a number of traps is received, the tank 28 is elevated so that the forward compartment 48 is above the rearward compartment 46;

(c) a subatmospheric pressure is established in the forward compartment and the rearward compartment is vented to atmosphere so that supernatant liquid is drawn to the forward compartment through a crossover pipe 70 having a first leg 72 extending generally parallel to a divider wall 44 from a location adjacent the tank floor 34, a second leg 74 extending into the forward compartment 48 and an intermediate portion 76 joining the first and second legs; and (d) the subatmospheric pressure is maintained in the forward compartment while the tank is lowered until the contents of the rearward compartment 46 are dewatered.

In view of the above, it will be seen that the several objects of the invention are achieved and other advantageous results attained.

As various chages could be made without departing from the scope of the invention, it is intended that all matter contained in the above description or shown in the accompanying drawings shall be interpreted as illustrative and not in a limiting sense.

What is claimed is:

1. A vehicle for collecting and dewatering the contents of sanitary sewer traps which includes solids and water, said vehicle comprising:

a frame;

an elongated tank mounted on said frame, said tank having a rearward end and a forward end;

means carried on said frame for elevating said forward end, said tank being pivotally connected to said frame adjacent said rearward end;

a generally vertically positioned divider wall disposed inside said tank dividing said tank into a rearward compartment for receiving the contents of said traps and a forward compartment adjacent said forward end;

a crossover pipe for conveying supernatant liquid from said rearward compartment to said forward compartment and having a first leg extending generally parallel to said wall from a location adjacent the floor of said rearward compartment, a second leg extending into said forward compartment, and an intermediate portion joining said legs;

inlet conduit means extending into said rearward compartment for conveying the contents of said traps into said rearward compartment and having an outlet end positioned in said rearward compartment;

pump means for selectively establishing a subatmospheric pressure in said rearward compartment or said forward compartment; and means for venting said rearward compartment to atmosphere whereby upon elevating the tank, venting said rearward compartment, establishing a subatmospheric pressure in the forward compartment and controllably lowering said tank, supernatant liquid is drawn into said forward compartment.

2. A vehicle as set forth in claim 1 further including a striker plate in said rearward compartment remote from said crossover pipe first leg, said outlet end of said conduit means directing the flow of the contents of said traps to impinge upon said plate so that the solids generally fall into said rearward compartment spaced from said first leg.

3. A vehicle as set forth in claim 1 wherein said rearward compartment has a door remote from said forward compartment to permit removal of the solids from said rearward compartment.

4. A vehicle as set forth in claim 1 further including means for venting said forward compartment to atmosphere, said pump means further comprising means for selectively establishing a superatmospheric pressure in said rearward compartment to force supernatant liquid from said rearward compartment into said forward compartment.

5. A vehicle as set forth in claim 1 further including at least one barrier wall extending intermediate the floor and ceiling in said forward compartment and terminating short of said ceiling to form a rear subcompartment adjacent said divider wall and a forward subcompartment.

6. A vehicle as set forth in claim 5 wherein said barrier wall has a baffle having an inlet opening from said rear subcompartment above the floor level and an outlet opening to another subcompartment at a level above the level of said inlet opening.

7. A vehicle as set forth in claim 6 wherein said forward subcomartment has an outlet positioned above the floor for draining relatively clear liquid from said forward subcompartment.

8. A vehicle as set forth in claim 7 further including second conduit means having inlets adjacent the bottoms of each of said subcompartments and an outlet, and also further including means for venting said forward compartment to atmosphere, whereby upon connecting the outlet of said second conduit means to said inlet conduit means, venting said forward compartment and establishing a subatmospheric pressure in said rear compartment, the solids at the bottoms of said subcompartments are drawn into said rearward compartment.

9. A vehicle as set forth in claim 5 further including means for chemically treating the liquid in said front compartment to promote precipitation of solids and to kill bacteria.

10. A vehicle as set forth in claim 1 further including an observation hatch at the top of said rearward compartment.

11. A vehicle as set forth in claim 2 further including means pivotally mounting said plate to the ceiling of said rearward compartment.

12. A method of dewatering the contents of sanitary sewer traps so that sludge remaining after dewatering is bladeable, using a vehicle having a frame carrying a tank divided into a rearward compartment and a forward compartment by a generally vertical divider wall, said vehicle having means for elevating said forward compartment with respect to said rearward compartment, said method comprising the following steps:

(a) establishing a subatmospheric pressure in said rearward compartment to draw the contents of a trap into said rearward compartment through an inlet conduit having an outlet;

(b) elevating said tank so that said forward compartment is elevated with respect to said rearward compartment;

(c) establishing a subatmospheric pressure in said forward compartment while venting said rearward compartment to atmosphere to draw supernatant liquid into said forward compartment through a crossover pipe having a first leg extending generally parallel to said divider wall from a location adjacent the tank floor, a second leg extending into said forward compartment and an intermediate portion joining said first and second legs; and (d) maintaining a subatmospheric pressure in said forward compartment and lowering said tank until the contents of said rearward compartment are dewatered.

* * * * *

UNITED STATES PATENT AND TRADEMARK OFFICE

CERTIFICATE OF CORRECTION

PATENT NO. : 4,816,167

DATED : March 28, 1989

INVENTOR(S) : Daniel V. Vanderslice

It is certified that error appears in the above-identified patent and that said Letters Patent is hereby corrected as shown below:

Column 2, line 12, after "number" insert --of--.

Column 4, line 57, change "establshments" to --establishments--.

Column 7, line 37, change "subcomartment" to --subcompartment--.

Signed and Sealed this

Twenty-fourth Day of October, 1989

*Attest:*

DONALD J. QUIGG

*Attesting Officer*

*Commissioner of Patents and Trademarks*